US007857493B2

(12) United States Patent
Engel

(10) Patent No.: US 7,857,493 B2
(45) Date of Patent: Dec. 28, 2010

(54) LUMINAIRE

(76) Inventor: Hartmut S. Engel, Monrepos Strasse 7, Ludwigsburg (DE) 71634

( * ) Notice: Subject to any disclaimer, the term of this patent is extended or adjusted under 35 U.S.C. 154(b) by 171 days.

(21) Appl. No.: 12/184,595

(22) Filed: Aug. 1, 2008

(65) Prior Publication Data

US 2009/0034256 A1 Feb. 5, 2009

(30) Foreign Application Priority Data

Aug. 2, 2007 (EP) ..... 07015211

(51) Int. Cl.
*F21S 8/08* (2006.01)

(52) U.S. Cl. ..... 362/431; 362/153; 362/287; 362/410

(58) Field of Classification Search ..... 362/147, 362/153, 153.1, 240, 249.03, 269, 287, 410, 362/414, 427, 428, 431, 364, 366
See application file for complete search history.

(56) References Cited

U.S. PATENT DOCUMENTS 5,031,085 A * 7/1991 Rustin ..... 362/431
5,649,760 A * 7/1997 Beadle ..... 362/287
6,273,578 B1 * 8/2001 Lai ..... 362/431
2006/0092646 A1 * 5/2006 Kelly et al. ..... 362/431

FOREIGN PATENT DOCUMENTS

| | | | |
|---|---|---|---|
| DE | 85 15 418 | U1 | 7/1986 |
| DE | 87 12 144 | U1 | 12/1987 |
| DE | 299 19 055 | U1 | 2/2000 |
| DE | 201 07 451 | U1 | 10/2001 |
| DE | 102 42 938 | A1 | 3/2004 |
| DE | 20 2006 017 356 | U1 | 2/2007 |

* cited by examiner

*Primary Examiner*—Y My Quach Lee
(74) *Attorney, Agent, or Firm*—Townsend and Townsend and Crew, LLP

(57) ABSTRACT

A standing lamp, wall lamp or pole-mounted lamp having a base member unit and a column unit which carries illuminants at least in the region of its free end and whose special feature consists of the fact that the column unit has an at least substantially planar functional surface in which at least one cut-out is provided for the reception of a lighting system, in particular of an LED lighting system, with a presettable light radiation direction; and in that the functional surface extends at a presettable angle with respect to the mounting unit which forms a part of the adjustable angle of the light radiation direction presettable together with the lighting system. The invention is furthermore directed to a floor lamp.

15 Claims, 5 Drawing Sheets

LUMINAIRE

CROSS-REFERENCE TO RELATED APPLICATIONS

This application claims priority to European Application No. 07 015 211.1, filed Aug. 2, 2007, the disclosure of which is herein incorporated by reference.

BACKGROUND OF THE INVENTION

The invention relates to a luminaire, in particular a standing lamp, a wall lamp or a pole-mounted lamp, having a base mounting unit and a column unit which carries illuminants at least in the region of its free end and which has at least one at least substantially planar functional surface (4) in which at least one cut-out (5) is provided for the reception of a lighting system. The invention is furthermore directed to a floor lamp.

Such a luminaire is known from DE 20 2006 017 356 U1.

This known luminaire is a table lamp with a sheet metal housing which is arranged inclined with respect to the vertical, whose lower region is angled for the formation of a foot and whose upper region is inclined more with respect to the vertical and is made for the reception of an illuminant. The housing region between the foot and the illuminant receiver is made as a cooling housing and includes a corresponding cooling module serving to dissipate the heat generated in the illuminant region. The lighting device connected to a heat dissipation plate of the cooling module is arranged fixedly and can be made as a light emitting diode or the like which transmits light through a window provided in the housing.

Further known luminaires of this kind as a rule include a column which has a luminaire head which is disposed opposite its mounting end, which is connected to the end of the column and which optionally extends inclined to the axis of the column.

A standing lamp radiating indirectly and directly is known from DE 299 19 055 U1 which has two vertical columns fixedly connected to a bottom plate and mutually spaced apart which carry a luminaire at their free end for the generation of indirect light and between which pivotably supported direct light luminaires are provided in the region between the support plate at the floor side and the luminaire generating the indirect light, the direct light luminaires being pivotably supported both relative to the vertical columns and relative to one another.

SUMMARY OF THE INVENTION

It is an object of the present invention to design a luminaire of the initially stated kind such that a structure is provided using simple components, which are thus economical to manufacture, which is suitable to satisfy different illumination functions, which can be adapted accordingly and which simultaneously takes high demands in an aesthetic regard into account.

This object is substantially satisfied in that the column unit comprises an obtuse angle section whose open side is closed by a coupleable, planar functional surface and in that the light radiation direction of the luminaire is determined both by the inclination of the functional surface with respect to the base mounting unit and by the adjustable light radiation direction of the lighting system.

It is possible by the use of a lighting system with optical focusing, in particular an LED lighting system, to make the column unit as a flat column in which the functional surface having at least one large-area light exit opening dominates the appearance. To complete the flat column, this functional surface is preferably combined with an obtuse angle section whose open side is closed by the functional surface so that an inner space with a comparatively small depth is created for the reception of the lighting system and of associated electrical and electronic functional elements.

It is of particular advantage for the functional surface to extend practically over the total length of the column unit since, in this manner, unlike conventional luminaires, an equipping of the functional surface with individual lighting systems can take place in dependence on the respective demands; i.e. in dependence on the respective lighting task, for example, an equipping with lighting systems in the region of the free end and simultaneously in the region close to the floor can take place such that a large-area illumination can also be combined with an accentuation lighting without the basic concept of the luminaire having to be changed or modified for this purpose.

The presettable inclination of the column unit with respect to the associated mounting unit results not only in a characteristic appearance of the luminaire, but above all also contributes to the avoidance of unwanted light contamination since a light radiation only takes place directly to the respective regions to be illuminated. The inclination of the column unit additionally serves for the presetting of a part of the setting angle for the light radiation direction formed together with the lighting system, in particular the LED lighting system. This in particular enables an ideal illumination close to the luminaire with high luminous intensity with a light radiation always directed to one side and, if desired, simultaneously enables an illumination of a more distant region disposed on the same side of the luminaire with a reduced intensity of illumination when lighting systems are positioned at different levels. This direct illumination of desired regions is always associated with the already mentioned avoidance of an irritating light contamination, i.e. of an unwanted brightening of ambient regions of the luminaire or of the night sky not to be illuminated.

Each LED lighting system preferably comprises at least one group of LEDs with individual or common optical focusing, with each group being arranged on a carrier element which is supported rotatably and whose inclination toward the axis of the cut-out provided in the functional surface is presettable. As a rule, four groups of a plurality of LEDs are, for example, combined to form a lighting system, with the single groups being individually alignable or settable.

The LED lighting system is made as a replaceable assembly and can be inserted into a preferably circular cut-out in the functional surface which can be closed by means of a cover glass. A cover panel is provided in the assembly spaced apart from the cover glass and arranged parallel to the cover glass, the cover panel having cut-outs corresponding to the number of the LED groups so that only the cover panel and the LED groups are visible behind the cover glass in the front view.

The diameter of the cut-out in the functional surface is preferably selected such that the region between the side limbs of the carrier section is fully utilized and thus a large-area light exit surface is obtained. A plurality of such light exit surfaces can be provided above one another and, optionally, also next to one another in the functional surface.

The planar functional surface is preferably formed by rectangular part units which can be screwed to the rear side section and which serve for the reception of the lighting system combined to form an assembly. These part units can be positioned along the total functional surface adjacent to one another or with a mutual spacing in dependence on the respective lighting task.

In accordance with a further preferred aspect of the invention, a floor lamp is realized in that at least one assembly of the described kind with a plurality of alignable LED lighting systems is inserted into a housing which can be sunk in the floor and which has a pot design, and this arrangement is closed by a stable light-permeable plate and a cover plate mounting the former plate and also fixing the assembly with respect to the housing. In this respect, the housing preferably has a peripheral flange which is designed in cross-section such that the cover plate is disposed flush at its free rim.

It is above all of advantage with this embodiment that the installation unit used in the already described embodiment variant and carrying the light sources can be used practically unchanged.

BRIEF DESCRIPTION OF THE DRAWINGS

Embodiments of the invention will be explained in the following with reference to the drawing.

DESCRIPTION OF THE PREFERRED EMBODIMENTS

Figure 1:
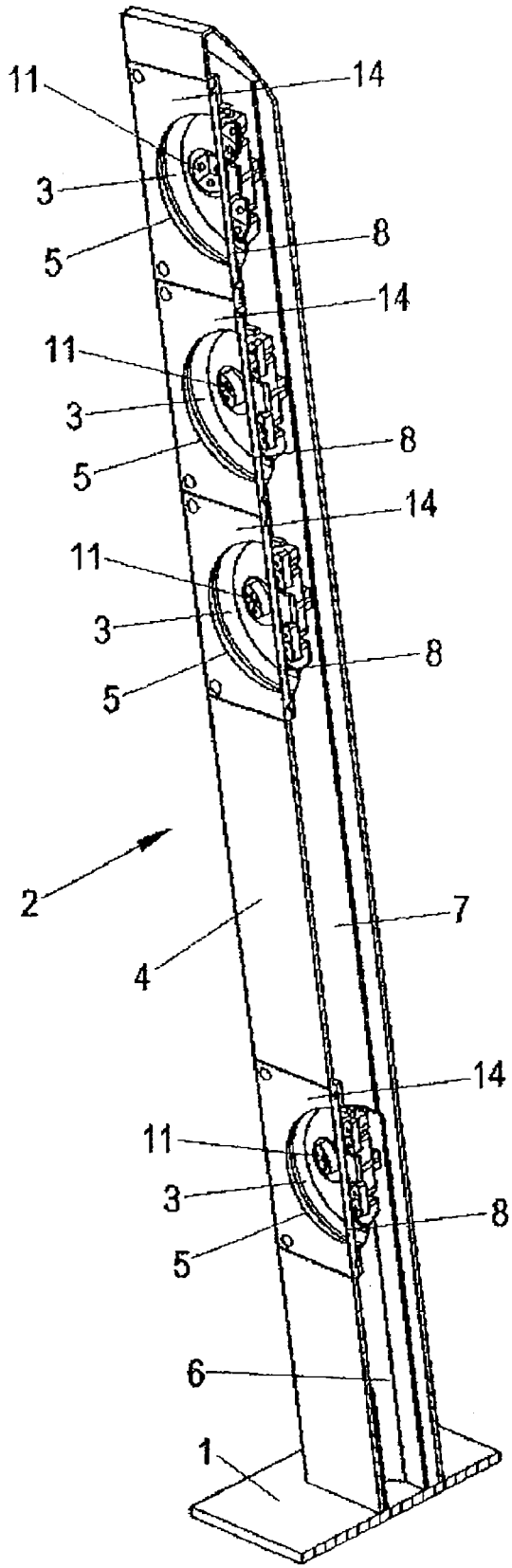
FIG. 1 is a perspective longitudinal sectional representation of an embodiment of a luminaire in accordance with the invention.

FIG. 1 shows an embodiment of the invention as an especially designed path lamp in the form of a perspective longitudinal sectional representation. It includes a base mounting unit 1 made in the form of a plate in this example and a column unit 2 extending with a presettable inclination relative to this base mounting unit 1.

The column unit 2 consists of an obtuse angle section 7, in particular made of aluminum, whose open side is closed by a planar functional surface 4. A plurality of LED lighting systems 3 are provided in the functional surface 4 distributed over the length or height of the column unit 2. These LED lighting systems can be associated with circular cut-outs 5 which can be provided directly in a continuous functional surface; but the functional surface 4 is preferably formed in the region of each LED lighting system 3 by a rectangular part unit 14 which can be screwed to the rear side section 7 and which serves in each case for the reception of an LED lighting system combined to form an assembly. These part units 14 can be arranged along the total functional surface adjacent to one another or with a mutual spacing in dependence on the respective lighting task.

Each LED lighting system 3 is preferably made as a replaceable component, with the cut-out 5 in the functional surface associated with the respective lighting system 3 being closed by a cover glass 8.

Each LED lighting system 3 preferably includes a plurality of LED groups 11 with an optical focusing which are mounted in an alignable manner.

A mounting space 6 disposed in the region of the column unit 2 at the floor side is utilized for the accommodation of ballast and other electrical components which may optionally be necessary.

It can be seen from FIG. 1 that the column unit 2 is arranged with an inclination with respect to the base mounting unit 1, with the degree of inclination being able to be selected in dependence on the purpose of the luminaire. A direct illumination of the respective desired regions is obtained by the arrangement of the illuminants set back with respect to the functional surface, by the presetting of the radiation direction of the illuminants and also by the inclination of the column unit 2, and it is simultaneously ensured that light contamination, i.e. a non-desired brightening of ambient regions, which only has a negative effect, is avoided.

Figure 2:
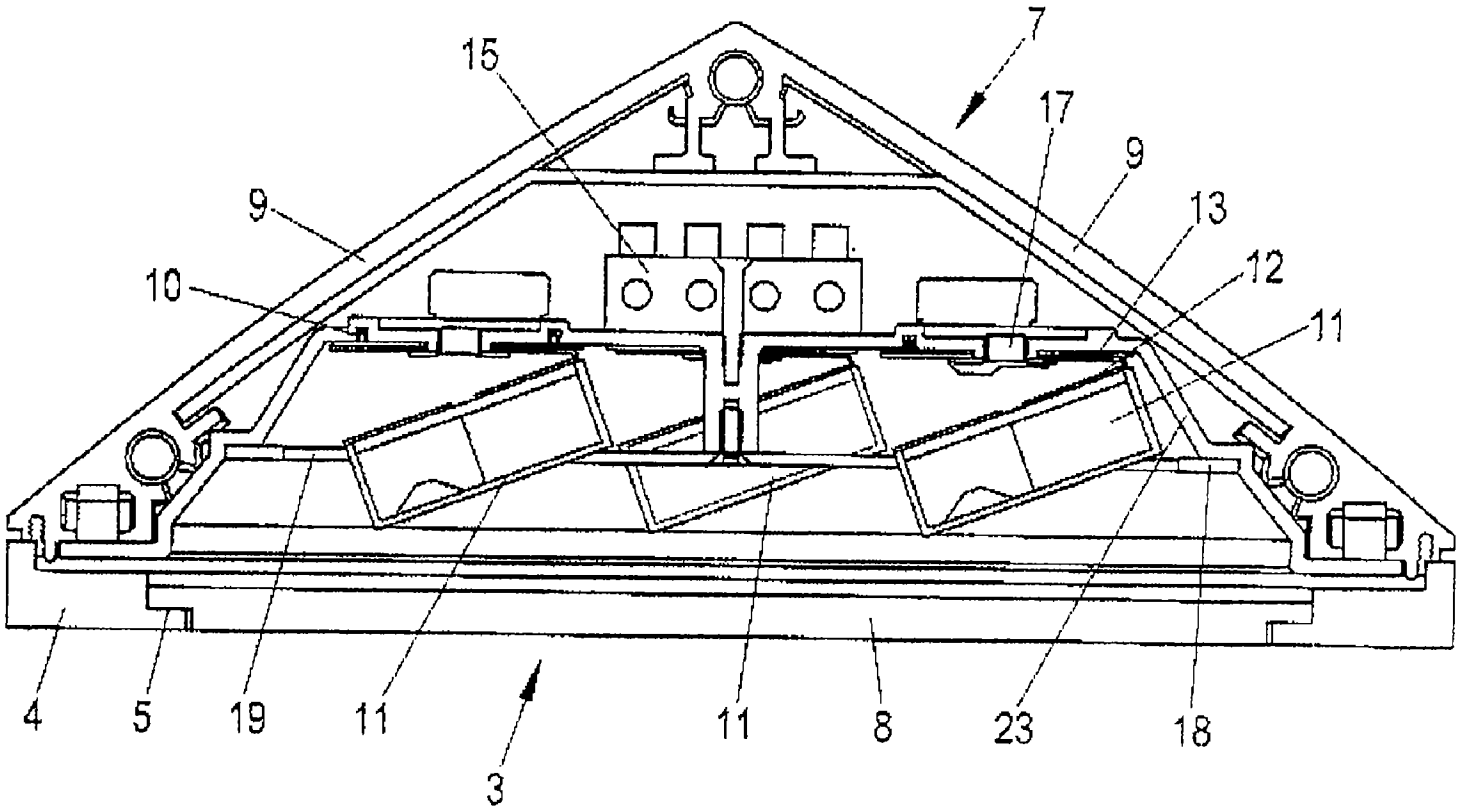
FIG. 2 is a sectional view of the luminaire in accordance with FIG. 1 for the explanation of the basic structure.

The sectional representation in accordance with FIG. 2 shows the specific embodiment of the obtuse angle profile section 7 with the side limbs 9 whose free end regions are made for the screw fixing of the functional surface 4. The LED lighting system 3 respectively associated with a cut-out 5 in the functional surface 4 represents a construction unit and respectively includes a plurality of LED groups 11 with optical focusing. These LED groups 11 are individually mounted and can be adjusted with respect to their radiation direction, for which purpose each LED group 11 is arranged on a carrier limb 12 of an angled part whose rotating limb 13 is fastened to an insert shell part 23.

A cover panel 18 which has a number of openings 19 corresponding to the number of the LED groups is fastened spaced apart from the cover glass 8 in the insert shell part 23.

As can be seen from FIG. 2, the LED groups 11 can engage partly through the openings 19; i.e. the LED groups are adjustable in their inclination and additionally rotatable in the region of these openings 19.

The connection of the LED units takes place via a connection terminal 15 which is fastened in the rear region of the insert shell part 23.

The requirement for an ideal illumination of the respective desired region disposed in front of the functional surface 4 is created by the adjustability of the radiation direction of the individual LED groups 11 in conjunction with the presettable inclination of the column unit 2.

Figure 3:
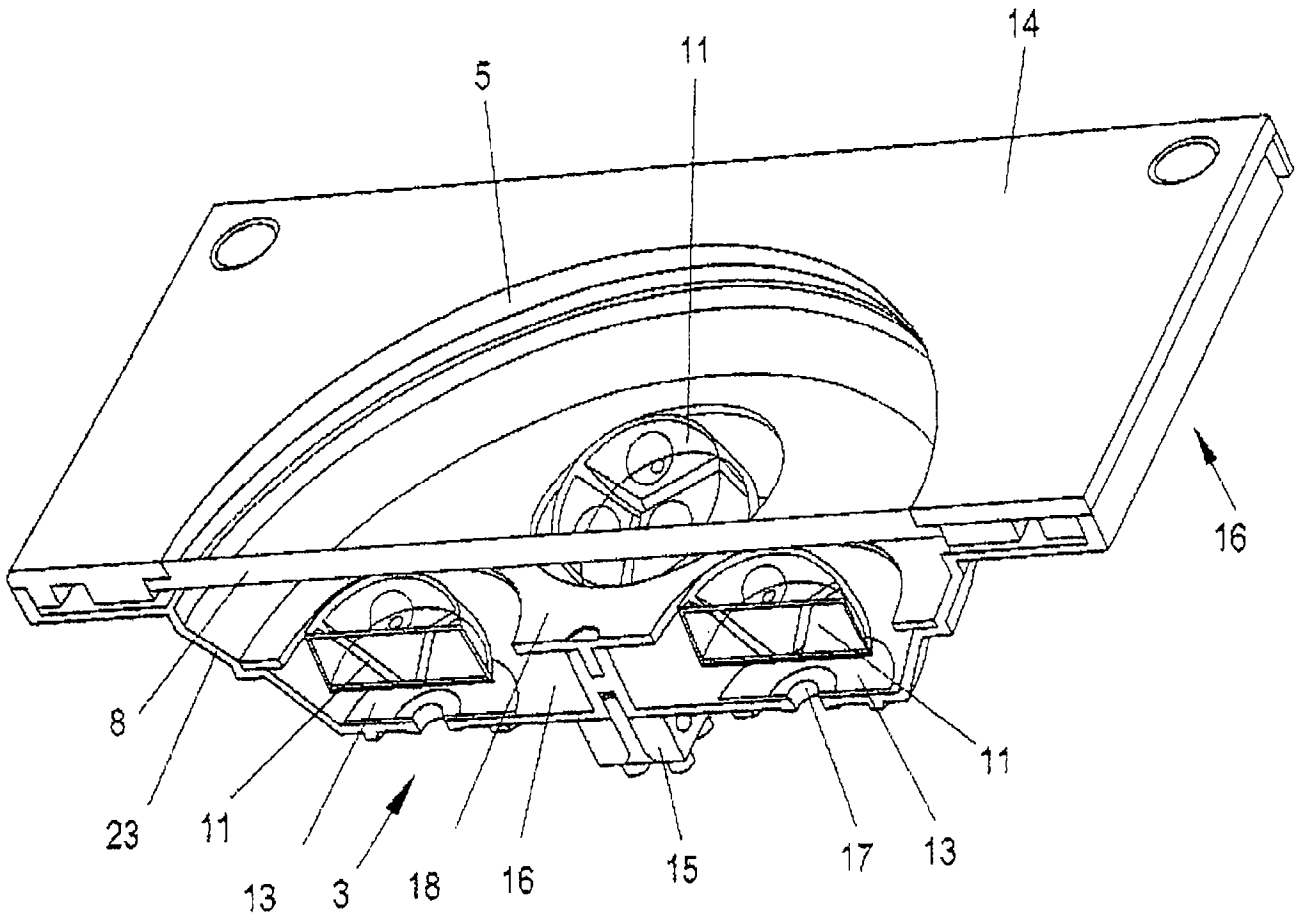
FIG. 3 is a perspective sectional representation of an embodiment of a part unit forming a component of the functional surface.

FIG. 3 shows a sectioned, perspective and detailed view of a part unit 14 of the functional surface 4 into which an LED lighting system 3 is integrated. This part unit 14 represents a sub-assembly which can be usable as a standard sub-assembly and which can be positioned in the respective desired position in the functional surface by screwing to the section 7.

As can be seen from FIG. 1, each of these part units 14 forms a component of the functional surface 4, with individual part units 14 being able to be arranged directly adjacent to one another or also with a mutual spacing from one another. Intermediate regions between part units 14 are closed by means of correspondingly adapted cover surfaces.

Figure 4:
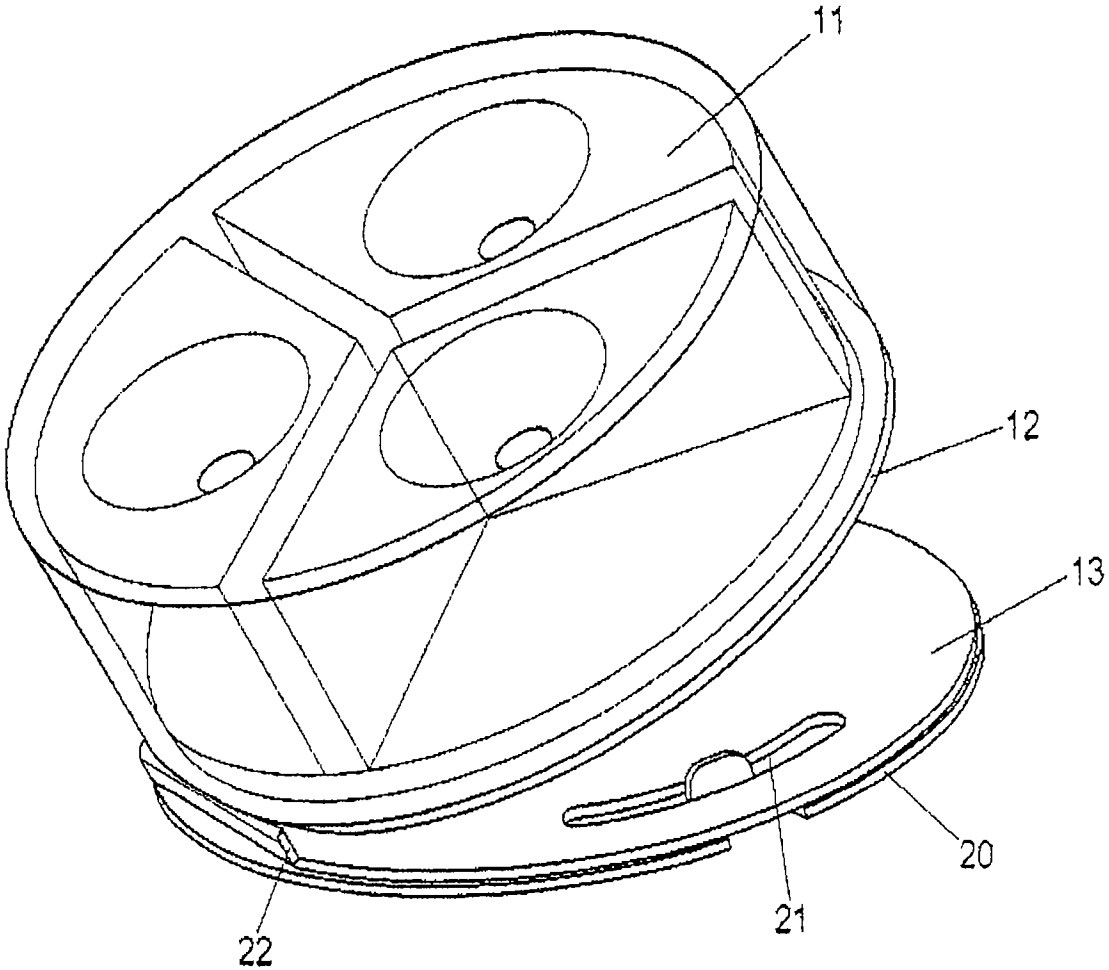
FIG. 4 is a representation of a preferred support of the LED groups of the lighting system.

FIG. 4 shows a schematic representation of a possible rotational/pivotal support of the LED groups 11 which is characterized by particular simplicity.

Each LED group 11 is associated with a carrier angular element whose outline shape of the carrier limb 12 and rotating limb 13 preferably corresponds to the cross-sectional shape of the LED group 11. The LED group 11 is fastened to the carrier limb 12 and this carrier limb 12 is connected via a folding joint 22 to the rotating limb 13, with the carrier limb 12, the rotating limb 13 and the folding joint 22 preferably being made of a stamped part. The angle between the carrier limb 12 and the rotating limb is adjustable in a presettable manner via the folding joint 22.

The plate-shaped rotating limb 13 is centrally rotatably supported, and indeed via a base plate 20 which has a step which engages into a rotary boundary slot 21 in the rotating limb 13.

The type of support of the rotating limb 13 at the insert shell part 23 can be seen from FIG. 2, with it also being visible that the base plate 20 is rotationally secured with respect to the insert shell part 23 via a stamped lug 10.

The luminaire in accordance with the invention can not only be used as a path lighting or a comparatively high pole-mounted luminaire by a corresponding design of the base mounting unit and the selection of the longitudinal extent of the functional surface, but can also be used as a wall lamp, with the mount being able to be designed such that the functional surface having the lighting units extends at a presettable angle with respect to the respective wall and the main radiation direction of the light can be preset in a simple manner by orientation of the functional surface.

Luminaires of very different lengths can be realized at comparatively low cost with a small effort by the combination of an extruded section with a substantially planar functional surface.

Figure 5:
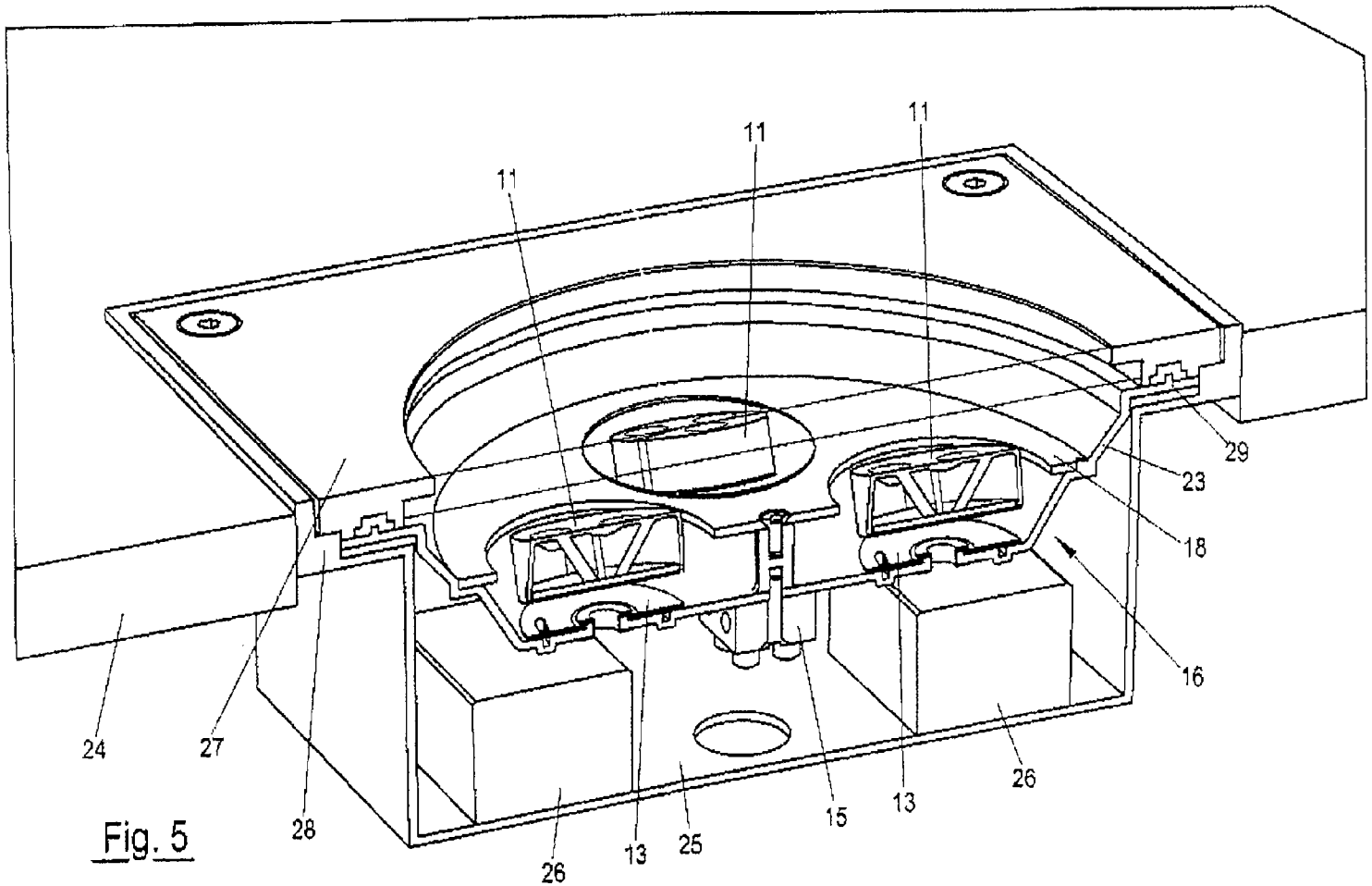
FIG. 5 is a sectional representation of a further embodiment of the invention in the form of a floor lamp.

FIG. 5 shows a further advantageous aspect of the invention in the form of a floor lamp.

It is of particular advantage here that the assembly 16 shown in FIG. 5 can be used in practically unchanged form and floor lamps can be created by integration of this assembly into a housing 25 which can be sunk in the floor 24, the floor lamps including one or more of these assemblies 16.

In this respect, the depth of the housing 25 is designed such that sufficient space is available beneath the respective assembly 16 for the reception of the electrical or electronic functional components, in particular of the ballast 26. At the opening side, the housing 25 has a stable peripheral flange 28 which is made for the shape-matched or flush reception of a stable cover plate. The peripheral flange 29 of the assembly 16 is clamped between the cover plate 27 and the horizontally extending region of the housing flange 28 with interposition of suitable sealing elements.

As already described in connection with the previous embodiments, the LED groups 11 included in the assembly 16 are rotatably and pivotably supported such that the respective desired and ideal radiation characteristics can also be set in combination with this floor lamp.

The rotational and pivotal support of the illuminants contributes in all embodiments, in particular in the embodiments having a plurality of lighting systems 3 distributed directly over the height of the luminaire, for example, to a floor-side region located in front of the luminaire being able to be effectively illuminated with a high light intensity, whereas the lighting systems 3 located in the upper region of the luminaire can be selected or set with respect to their radiation characteristics such that the respective desired illumination of a larger spatial region can be ensured with a lower light intensity.

REFERENCE NUMERAL LIST

1 base mounting unit
2 column unit
3 LED lighting system
4 functional surface
5 cut-out
6 receiving space
7 section
8 cover glass
9 side limb
10 stamped lug
11 LED group with optical focusing
12 carrier limb
13 rotating limb
14 part unit of the functional surface
15 connection terminal
16 assembly
17 axis of rotation
18 cover panel
19 opening in cover panel
20 base plate
21 boundary slot
22 folding joint
23 insert shell part
24 floor
25 housing
26 ballast
27 cover plate
28 flange
29 peripheral flange

The invention claimed is:

1. A luminaire for a lamp, including a base mounting unit and a column unit which carries illuminants at least in a region of its free end and which has at least one at least substantially planar functional surface in which at least one cut-out is provided for the reception of a lighting system, the column unit comprising an obtuse angle section having an open side closed by the substantially planar functional surface; a direction in which the luminaire emits light radiation being settable both by a variability of an inclination of the functional surface with respect to the base mounting unit and by an adjustability of a light radiation direction of the lighting system relative to the inclination of the functional surface, wherein the functional surface extends at least substantially over the total length of the column unit and is suitable for the reception of the lighting systems.

2. A luminaire in accordance with claim 1, wherein the lighting system comprises an LED lighting system; and wherein the LED lighting system comprises at least one group of LEDs with individual optical focusing which is arranged on a carrier element whose inclination toward an axis of the cut-out provided in the functional surface is presettable.

3. A luminaire in accordance with claim 1, wherein the lighting system comprises an LED lighting system; and wherein the LED lighting system comprises at least one group of a plurality of LEDs with common optical focusing for the plurality of LEDs which is arranged on a carrier element whose inclination toward an axis of the cut-out provided in the substantially planar functional surface is presettable.

4. A luminaire in accordance with claim 1, wherein the lighting system comprises an LED lighting system which includes a plurality of individual groups of LEDs with optical focusing for each group of LEDs whose inclination toward an axis of the associated cut-out is individually adjustable.

5. A luminaire in accordance with claim 4, including a Cardan joint arrangement for setting the inclination of the substantially planar functional surface in different directions by an adjustability of a carrier element for the LEDs.

6. A luminaire in accordance with claim 5, wherein each carrier element is formed by a limb of a holding member having another limb that is rotatably supported; and wherein the angle between both limbs is adjustable.

7. A luminaire in accordance with claim 6, wherein the carrier element for the LED groups is made of a stamped part, the carrier limb being adjustably connected to a rotating limb via a folding joint and wherein the rotating limb has a rotating boundary slot.

8. A luminaire in accordance with claim 1, wherein the lighting system is equipped with LED units and comprises a replaceable assembly.

9. A luminaire in accordance with claim 8, wherein a cover panel is mounted in and bounded by an insert shell part in each assembly, wherein the LED units are arranged in a plurality of LED groups, and wherein said cover panel has an opening for each LED group within which each LED group can be rotated and pivoted.

10. A luminaire in accordance with claim 1, wherein the cut-out is a circular cut-out provided in the functional surface for each lighting system and is closable by means of a cover glass held by the substantially planar functional surface.

11. A luminaire in accordance with claim 1, wherein the obtuse angle section includes diverging side limbs and wherein a diameter of the cut-out substantially corresponds to an inner spacing of the side limbs of the obtuse angle section.

12. A luminaire in accordance with claim 1, wherein the planar functional surface is formed at least partly by rectangular part units which can be screwed to the obtuse angle section and into which an assembly including the lighting system is respectively integrated.

13. A luminaire in accordance with claim 12, wherein each part unit forms a closed, sealed system with the associated assembly and can be integrated in the column unit in a sealed manner.

14. A luminaire in accordance with claim 1, wherein the column unit has a mounting side that forms a receiving space for functional elements.

15. A luminaire in accordance with claim 1, wherein the mounting unit is made of a floor mount or wall mount and is shaped as a plate.

* * * * *